US006672294B1

(12) United States Patent
Pirone

(10) Patent No.: US 6,672,294 B1
(45) Date of Patent: Jan. 6, 2004

(54) ROCKER BOX OIL SEPARATION VENT SYSTEM

(76) Inventor: Thomas A. Pirone, 43 Lamppost Dr., West Redding, CT (US) 06896

( * ) Notice: Subject to any disclaimer, the term of this patent is extended or adjusted under 35 U.S.C. 154(b) by 0 days.

(21) Appl. No.: 10/340,313

(22) Filed: Jan. 9, 2003

(51) Int. Cl.[7] ..... F01M 1/00
(52) U.S. Cl. ..... 123/572
(58) Field of Search ..... 123/572, 573, 123/574

(56) References Cited

U.S. PATENT DOCUMENTS

| | | | | |
|---|---|---|---|---|
| 4,844,032 | A * | 7/1989 | Groeger et al. | 123/574 |
| 6,308,695 | B1 * | 10/2001 | Watanabe et al. | 123/572 |
| 6,425,451 | B2 * | 7/2002 | Yoshida et al. | 123/572 |
| 6,439,215 | B1 * | 8/2002 | Sato et al. | 123/572 |
| 6,561,154 | B2 * | 5/2003 | Ito et al. | 123/572 |

OTHER PUBLICATIONS

Harley–Davidson Big Twins Owners Manual; C. Choate, T. Schauwecker; J. H. Haynes; Haynes; Publications, Inc. 1999 pp. 70–73, 96–98 Harley–Davidson Sportsters 1970–1993; Owners Workshop Manual; C. Choate, T. Schauwecker, J. H. Haynes Publications Inc.; 1990–1993, pp. 62–66.

* cited by examiner

*Primary Examiner*—Marguerite McMahon
(74) *Attorney, Agent, or Firm*—Ware Fressola Van Der Sluys & Adolphson LLP

(57) ABSTRACT

A rocker box for a motorcycle engine incorporates a crankcase breather air return passageway formed as a labyrinth with numerous sharp zig-zag turns lubricating oil fog or mist coalescing into droplets in the airstream accumulates as deposited liquid oil on the interior surfaces of the portals and chambers of the labyrinth, and is conducted by gravity through suitable drain vents to be delivered directly to the crankcase. The airstream is thus largely separated from entrained oil fog or mist, minimizing any collecting of oil on the air cleaner or filter through which the breather airstream is delivered on its way out of the crankcase, reducing or eliminating any accumulation of oil on the air filter exposed to the external environment, and substantially avoiding the introduction of entrained oil in intake air delivered to the engine for combustion.

11 Claims, 5 Drawing Sheets

ROCKER BOX OIL SEPARATION VENT SYSTEM

This invention relates to novel oil separating vent systems for motorcycle engines, removing a major amount of lubricating oil droplets and mist from the crankcase breather airstream passing through the rocker box chamber as the airstream travels to the air cleaner.

By separating lubricating oil from the airstream propelled by descending pistons from the crankcase up to the rocker box, and diverting the oil for return to the crankcase, the advantages of conserving the oil and minimizing pollution by escaping oil are achieved at all times when the engine is running.

PRIOR ART

Conventional motorcycle engines offer inadequate separation of lubricating oil from the crankcase breather airstream, and the present invention performs this separation far more efficiently than conventional engines. Thus the objectives of the present invention are to conserve lubricating oil and minimize escaping oil pollution by enhancing the separation effectiveness of the engine itself in delivering the crankcase breather airstream and the separated oil back to the crankcase.

Conventional motorcyle engines normally direct the breather airstream from the crankcase through the rocker box, then to the air cleaner or filter receiving intake air for delivery to the carburetor. This air filter is externally exposed, and if oil entrained as fog or mist in the breather airstream is collected by the air cleaner, such oil accumulates, blocking the air cleaner and may drip outside the engine, collecting on the ground below or on the rider's clothing.

BRIEF SUMMARY OF THE INVENTION

The present invention employs a zig-zag labyrinth path for conducting the breather airstream carrying oil mist or fog and droplets of lubricating oil through the rocker box on its way to the air filter. As the oil mist coalesces into droplets, these droplets acquire momentum from the movement of the breather airstream carrying them, and at every change of direction in the zig-zag airstream path, momentum carries the droplets out of the airstream to be deposited on the separator labyrinth walls. These deposited droplets of lubricating oil then collect and descend by gravity toward the bottom of the labyrinth, where they are conducted by vents and drain ports directly to drain passages leading back to the crankcase oil sump.

Accordingly, a principal object of the invention is to maximize the separation of entrained lubricating oil from the moving crankcase breather airstream.

Another object of the invention is to collect this separated lubricating oil efficiently and return it directly to the crankcase.

A further object of the invention is to minimize the escape of lubricating oil from the engine via accumulation in the air filter.

Still another object is to minimize the traces of accumulated oil in the intake air delivered to the carburetor for combustion, which thereby avoids contributing burned oil to the engine's exhaust.

Other objects of the invention will in part be obvious and will in part appear hereinafter.

The invention accordingly comprises the features of construction, combinations of elements, and arrangements of parts which will be exemplified in the construction hereinafter set forth, and the scope of the invention will be indicated in the claims.

THE DRAWINGS

For a fuller understanding of the nature and objects of the invention, reference should be made to the following detailed description taken in connection with the accompanying drawings, in which.

BEST MODE FOR CARRYING OUT THE INVENTION

Figure 2:
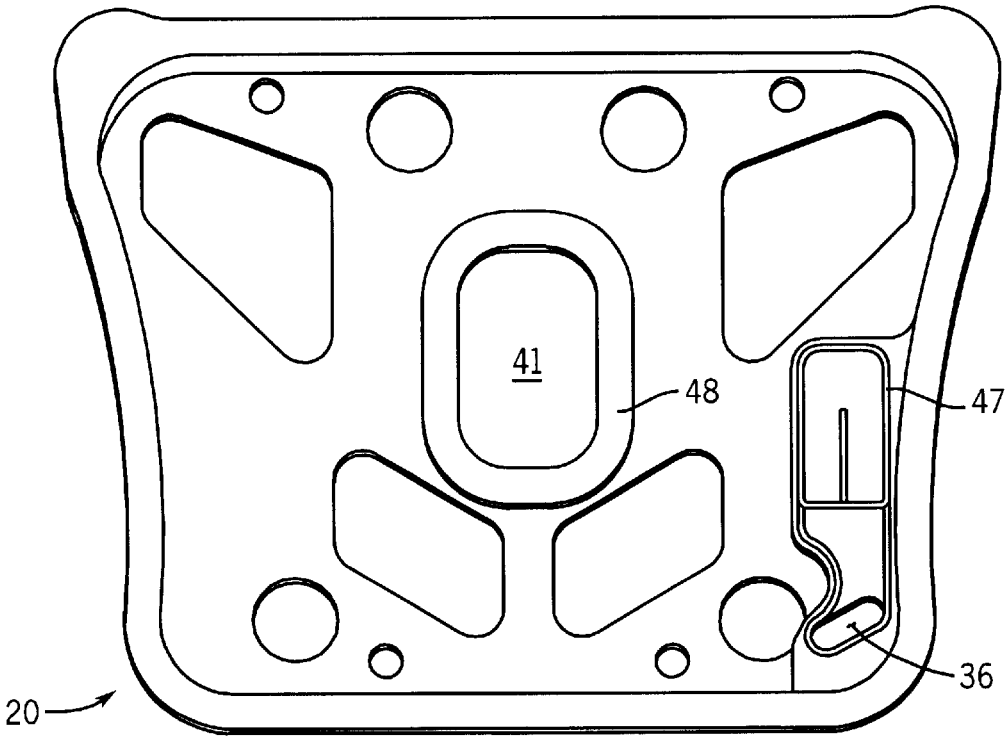
FIG. 2 is a corresponding perspective bottom view of a rocker box cover designed to mate with the rocker box of FIG. 1, shown removed therefrom, and raised and rotated rearwardly about a transverse axis, which would lie in the plane 4—4, shown in FIG. 3.
Figure 1:
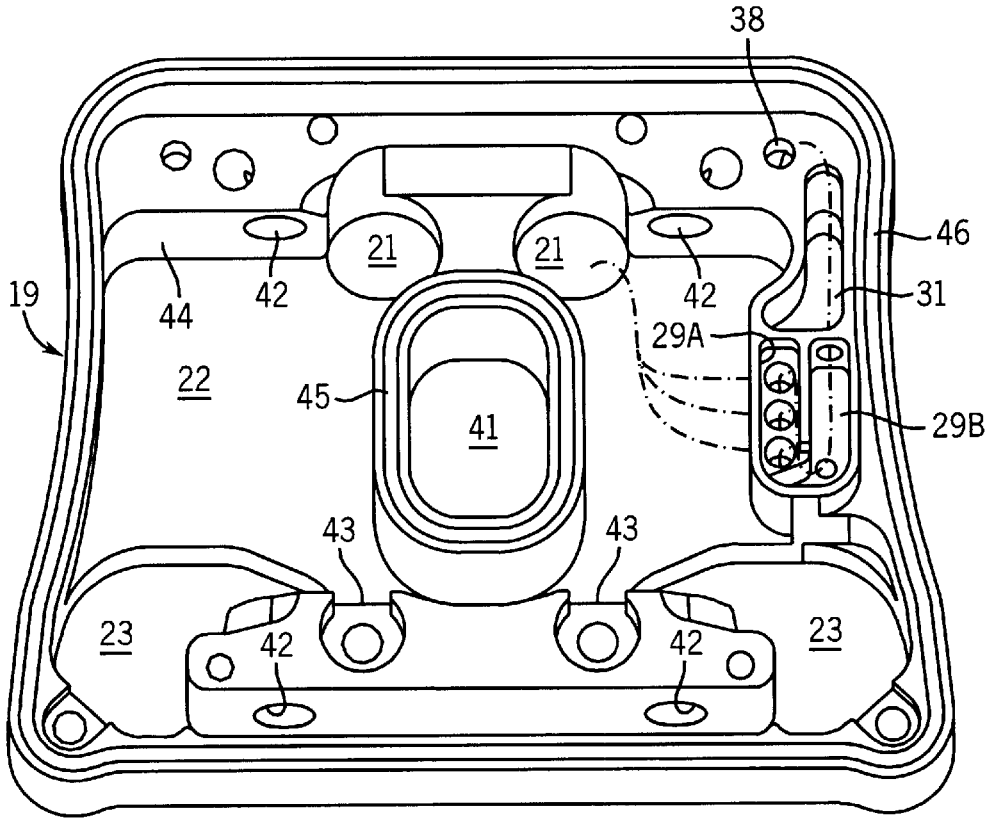
FIG. 1 is a schematic perspective front-top plan view of an engine rocker box incorporating the present oil separator labyrinth invention.

FIGS. 1 and 2 show the housing or rocker box in which the valve rocker arms are mounted for pivoting movement, actuated by the push rods, and respectively opening and closing the valves of the engine. Push rods, the rocker arms and their mounting bolts have been removed from the rocker box shown in FIG. 1 in perspective, where the rear part of the rocker box 19 contains at its central portion two push rod entrance ports 21, leading into the rocker chamber 22 where the rocker arm shafts are mounted to support the rocker arms for pivoting movement. All of these parts have been removed from the rocker box shown in FIG. 1 in order to simplify the description of the other parts of the rocker box forming the central features of the present oil separating vent system.

Figure 6:
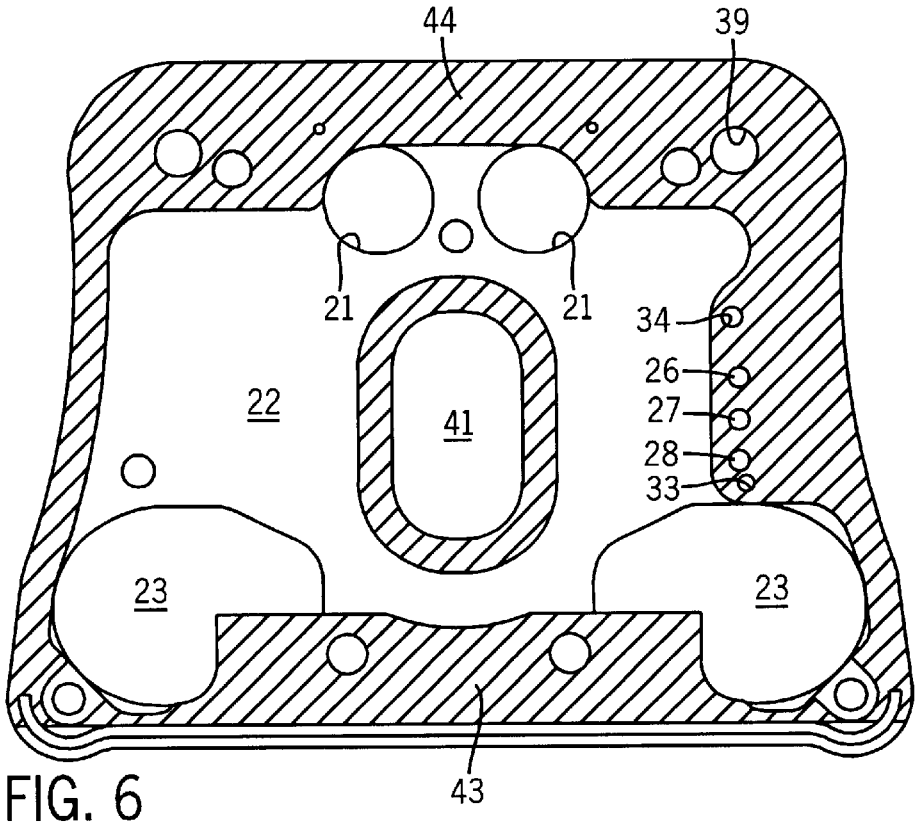
FIG. 6 is a cross-sectioned plan view of the rocker box, taken along the plane 6—6 shown in FIG. 5.

Also shown in FIG. 1 are the two large apertures 23 in the front corners of rocker box 19. These apertures 23 accommodate both of the valve housings, through which the valve stems extend upward for actuating movement by the rocker arms. In the central portion of FIG. 1 a heat escape chimney 41 is illustrated extending through the rocker box from bottom to top. Directly behind chimney 41 are the two push rod entrance ports 21 through which the push rods deliver thrust from the camshaft upward to actuate the rear ends of the rocker arms. These are so named because of their rocking pivoting movement; when the push rods actuate them, they create a pivoting movement through a short arc sufficient to deliver the same pivoting movement at the forward end of these push rods to the stem of the respective valves extending upward through the valve apertures 23 for engagement of the valve stems to be actuated by the rocker arms. The rocker arms (not shown) extend from the front to the rear, spanning the central chamber 22 of the rocker box 19, being mounted for pivoting movement on shafts (not shown) mounted in rocker arm shaft bores 42 found in the front stanchion 43 and the rear stanchion 44. These stanchions are the sturdy thick portions of the walls of the rocker box 19 positioned across the front and rear regions of box 19, as illustrated in the figures and particularly in FIG. 6 and FIG. 7.

Figure 7:
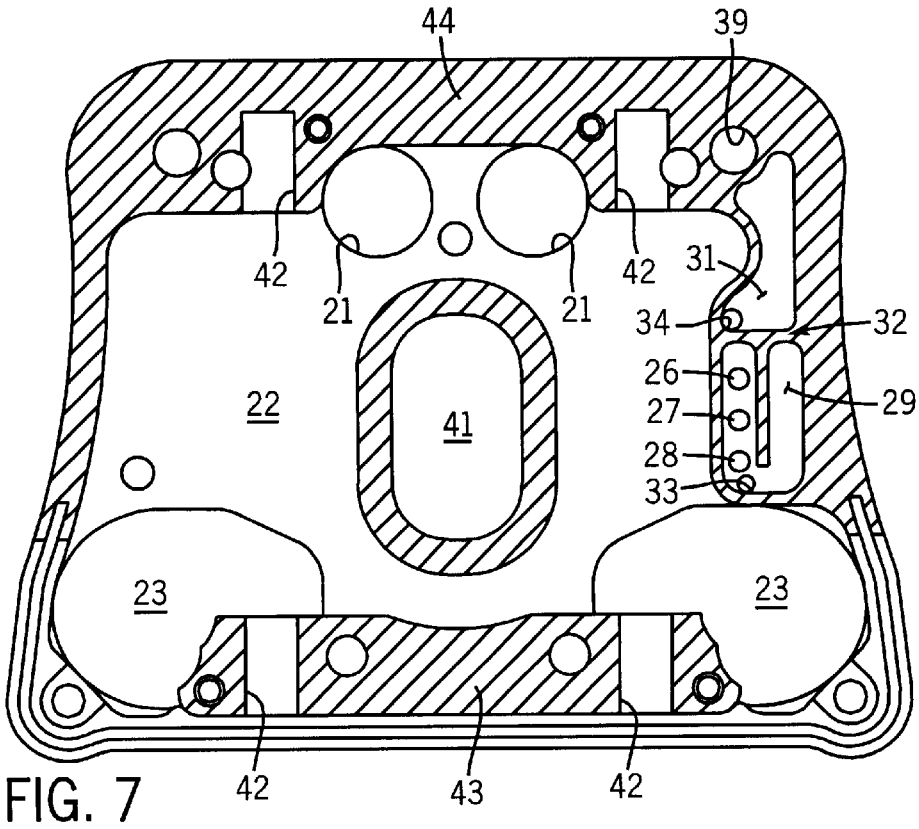
FIG. 7 is a similar cross-sectioned plan view of the rocker box, taken along the plane 7—7 shown in FIG. 5.

On each piston downstroke, crankcase air is forced up the push rod tubes 21 into the central rocker chamber 22 in the rocker box 19. The pressure applied to this crankcase airstream propelled upward to the rocker box from the crankcase causes it to travel through chamber 22 toward any escape path which it encounters. The separation vent system of this invention provides just such an escape path. As indicated in the schematic diagram of FIG. 9, the crankcase breather airstream 25 is accepted by three vertical air inlet holes 26, 27 and 28 opening upward in the overlying surface of a deep intake slot 24 formed beneath the overhanging separation chamber structure 29-31 illustrated at the right hand side of FIGS. 1, 3, 6 and 7. The intake slot 24 is best seen in the cross section of FIG. 4. The slot 24 runs from the front toward the rear of the rocker box 19 opening at the valve aperture 23 at the right hand front corner of box 19 and extending rearwardly toward the right rear corner of the rocker box where it is shown schematically in the unrolled developed diagram of FIG. 8. Slot 24 thus underlies the separation chambers at 29A, 29B and 31 which are arrayed from front to rear above slot 24 as shown in FIGS. 3 and 7.

Figure 3:
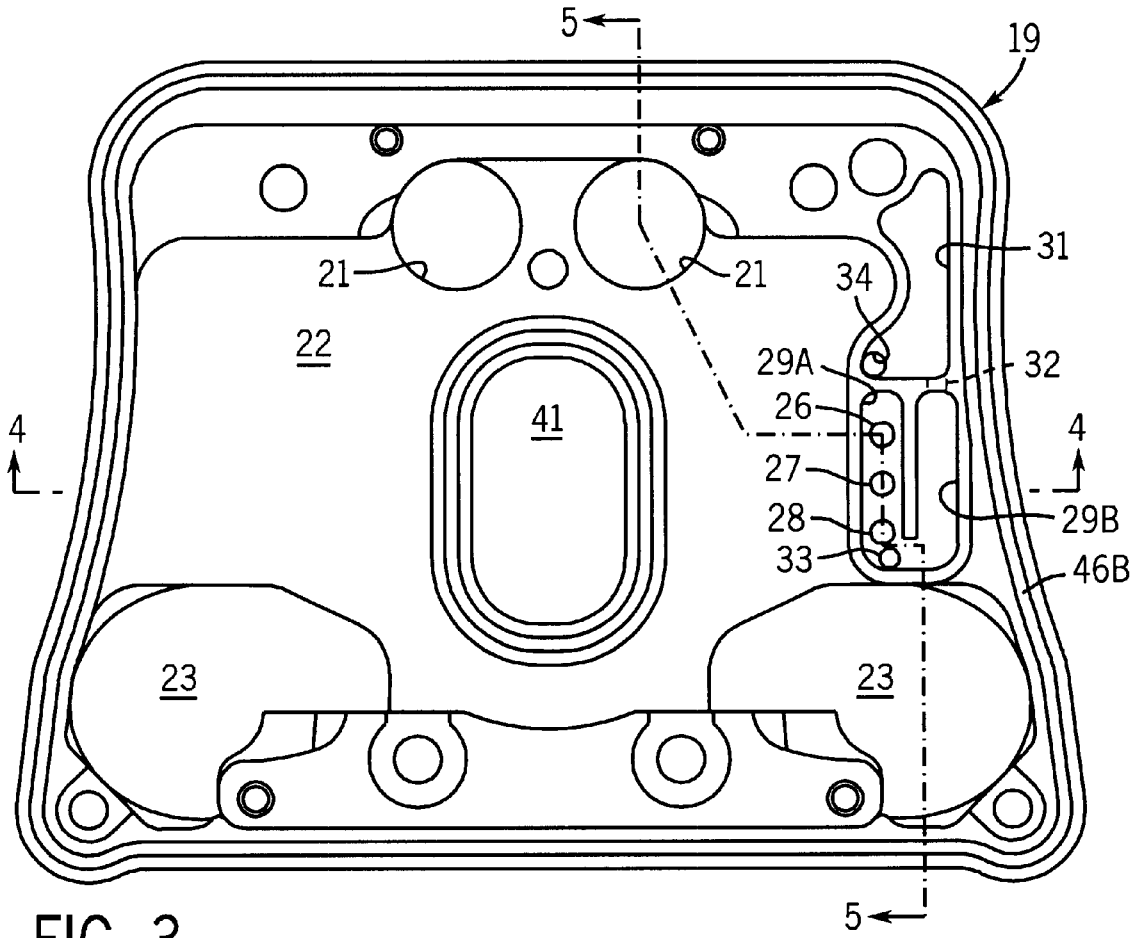
FIG. 3 is a top plan view of the rocker box of FIG. 1.
Figure 4:
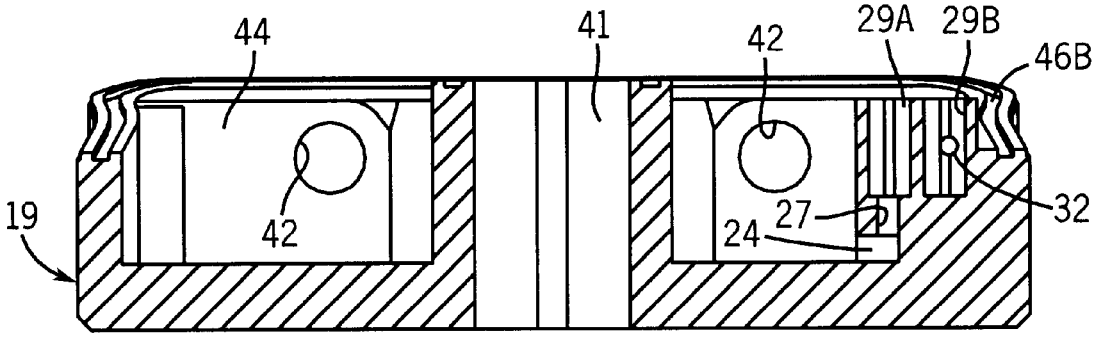
FIG. 4 is a cross-sectioned front elevation view of the rocker box, taken on the plane 4—4 shown in FIG. 3.
Figure 5:
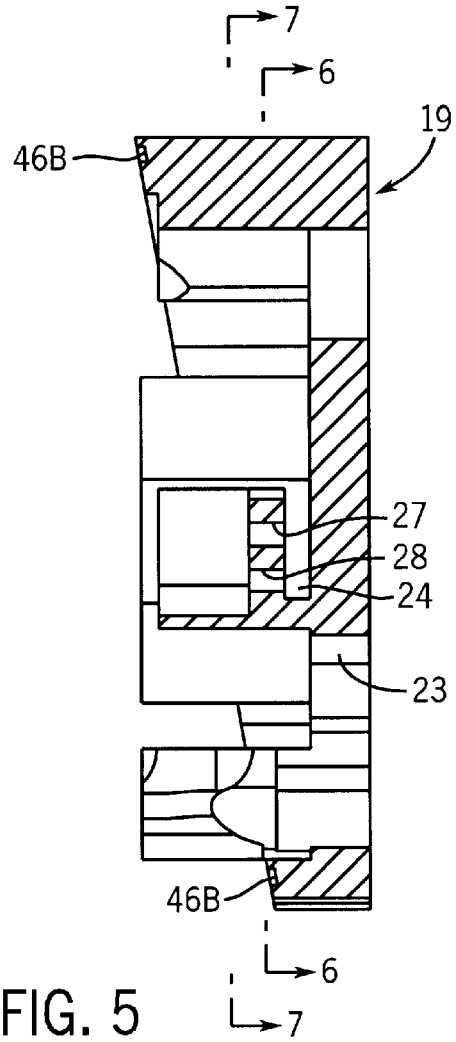
FIG. 5 is a cross-sectioned side elevation view of the rocker box, taken on a compound plane 5—5 shown in FIG. 3.

As best shown in FIG. 3, chamber 29A is the first of these separation chambers that receive the airstream containing oil fog or mist, and the airstream issuing into the upper portion of chamber 29A is immediately redirected abruptly forwardly from all three inlets 26, 27 and 28 toward the front of separation chamber 29A where the airstream is recombined and forced to make a 180 degree sharp turn into companion separation chamber 29B on the outer portion of the separation system. In chamber 29B the airstream finds itself seeking another escape exit, which is provided by a separator lip portal 32 found in a partition at the rear end of chamber 29B. The airstream passing through this portal 32 issues into the lower portion of the third oil separation chamber 31.

Oil mist droplets deposited by their own inertia on the walls of chambers 29A and 29B at these sharp turns descend by gravity toward the floor of these chambers where they are free to flow through a drain hole 33, found close to the 180 degree turn between the two chambers 29A and 29B, extending downward through the floor of those chambers assembly into slot 24. After passing through separator lip portal 32, additional oil droplets may be collected and deposited by their own inertia as the airstream travels rearwardly, turns sharply upward and again finds an exit which is provided by an overlying zig-zag conduit 35, located at the upper rear portion of chamber 31, and leading to a U-shaped conduit 36 recessed upwardly in the underside of rocker box cover 20 as shown schematically in FIG. 8 and also appearing in FIG. 2, located at the right rear corner of cover 20 overlying the rear portion of chamber 31 when the cover 20 is rotated forward and lowered into contact with the rocker box 19.

Figure 9:
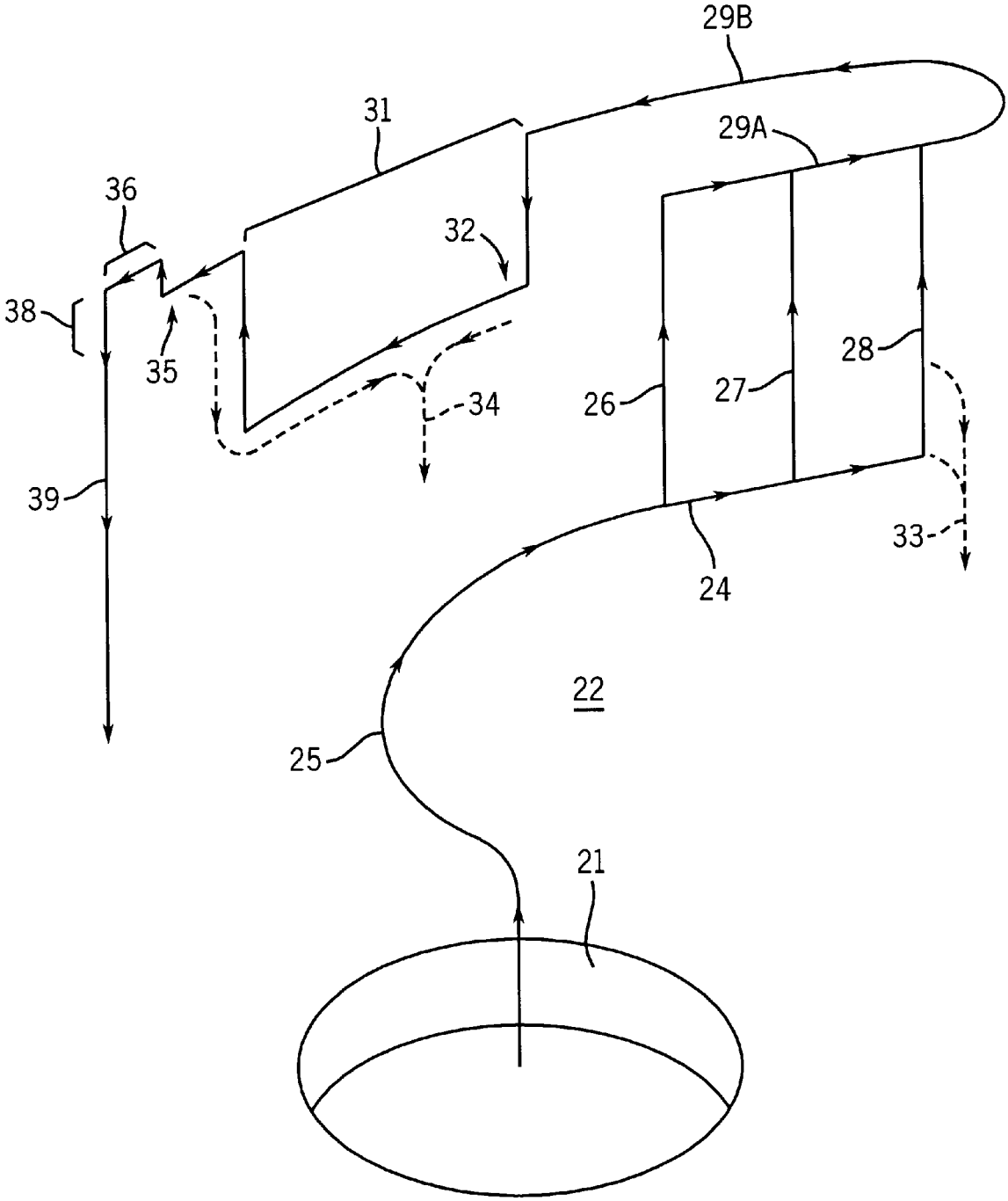
FIG. 9 is a perspective schematic view of the crankcase airstream's zig-zag labyrinth path, showing its many abrupt changes of direction.

The schematic diagram of FIG. 9 illustrates sharp corners in the overall zig-zag path followed by the crankcase breather airstream 25 after it turns upward through vertical air inlets 26, 27 and 28, then turns forward through separation chamber 29A, reverses direction 180° and then passes through chamber 29B. The airstream then descends, turns 90° to pass through the lip portal 32, travels rearwardly along the length of the third separation chamber 31 and then rises 90° to pass through the zig-zag conduit 35 and ascends into the overlying recessed U-shaped passage 36 in cover 20 from which it again turns a right angle corner and enters a vertical exit air passage 38 leading downward through cover 20 into a larger air passage 39 descending vertically to the cylinder head of the engine, and thence to the crankcase.

Thus every portion of the crankcase breather airstream passes through nine separate right angle changes of direction as well as the 180 degree reversal of direction between separation chambers 29A and 29B on its way to the air cleaner. At each of these right angle turns, it can be expected that any oil fog or mist which has collected into droplets will be flung off upon each abrupt change of direction, to be deposited on the walls of these various chambers or passages and as indicated by the short arrows 33 and 34 shown in two paths in FIG. 9, such deposited oil will travel backward into slot 24 by way of a drain hole 33 in chamber 29A or the drain hole 34 in the floor of chamber 31 again into slot 24, or finally down the exit air passages 38 and 39, all to return to the cylinder head and to be conducted to the passages therein and back to the oil sump at the bottom of the crankcase.

Figure 8:
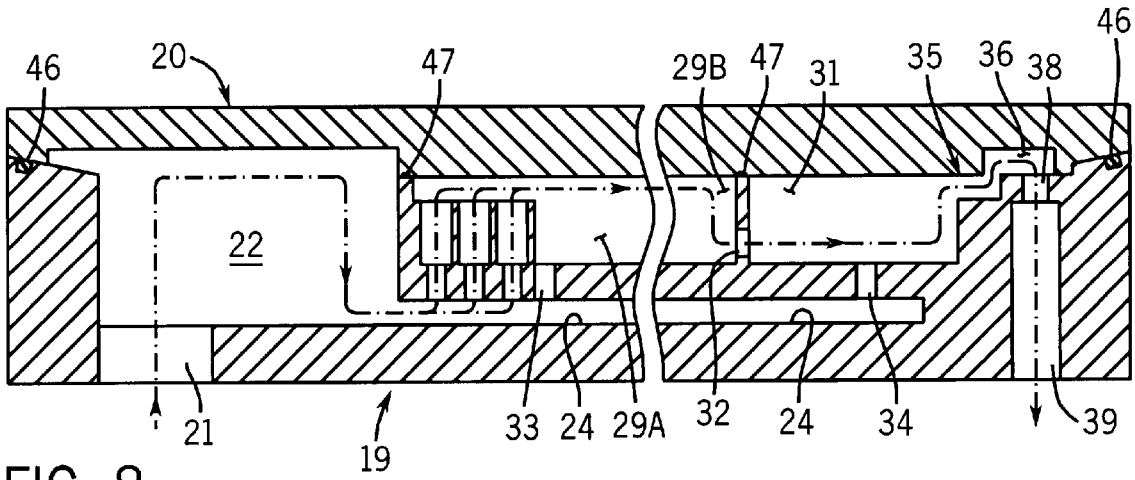
FIG. 8 is a schematic diagram shown as an end view of the rocker box illustrating the crankcase air stream's zig-zag labyrinth path in a "developed" cross-section, unrolled on a single plane.

These numerous sharp 90 degree turns in the return path of the crankcase breather airstream 25 as it travels through the oil separation vent system of this invention, as illustrated in FIGS. 8 and 9, has the effect of separating a large percentage of entrained oil from the airstream and conducting it by gravity back to the crankcase oil sump, thus achieving the objectives of the present invention with considerable success. This success is achieved without any moving parts, merely accepting the airstream propelled by the descending piston through the pushrod entrance ports 21 and the rocker box chamber 22 into slot 24 and the twists and turns of the labyrinth passageway of the two separation chambers 29A and 29B, the third separation chamber 31, and the various small openings and apertures through which the air must travel in order to leave the engine crankcase through the air cleaner.

A series of three "O-ring" gaskets are employed to assure that none of this breather airstream escapes from the rocker box as it travels therethrough. These gaskets are a first gasket 45 recessed in the upper rim of heat escape chimney 41 which is flattened by contact with a chimney-shaped boss 48 formed on the underside of rocker box cover 20; a long O-ring type gasket 46 encircling the upper rim of the rocker box 19 and recessed in a groove formed therein as shown in FIG. 1; and a somewhat smaller O-ring shaped gasket 47 encircling the upper portion of the chambers 29A and 29B, 31 and the recessed passage 36, and embraced in a matching shaped mounting slot formed in the underside of cover 20, which can be lowered into engagement with the facing upper surfaces of the walls of rocker box 19 forming the periphery of these chambers 29A, 29B, and 31. The engagement of the O-ring gaskets 46 and 47 embraced between the rocker box 19 and the cover 20 is best shown in the diagram of FIG. 8.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A box-shaped housing having a floor, walls and a cover enclosing a chamber surmounting a motorcycle engine cylinder and connected to receive a stream of breather air from the engine's crankcase carrying lubricating oil as a mist, said housing providing an oil-separating escape vent path connected to deliver separated oil via an exit oil passage directly to the crankcase while sending the breather airstream separately to a filter on the carburetor, comprising in combination an oil separating enclosure protruding from a wall of said housing into said chamber above the housing floor thus defining a slot;

said oil separating enclosure defining a first elongated oil separation chamber and an adjacent second elongated oil separation chamber;

a plurality of upwardly directed vent passages connecting said slot to the interior of said first elongated oil separation chamber in said oil separating enclosure;

a partition incorporating a central lip portal between the first and second elongated oil separation chambers;

a groove formed in said cover overlying said second elongated oil separation chamber remote from said lip portal, opening into an air passage formed in said housing connected to an air conduit formed in said cylinder head connected to return said breather airstream to the carburetor;

and drain hole means connecting said elongated separation chambers by way of said slot directly to the crankcase, whereby the breather airstream propelled by every downstroke of the piston travels successively through respective transitions between the chamber, the slot, the vent passages, the first elongated oil separation chamber, the lip portal, the second elongated oil separation chamber, the cover groove and the air passage, and the airstream, encounters a change of direction at each said transition, producing a zig-zag labyrinth path traveled by the airstream, causing oil mist droplets entrained in the breather airstream to be deposited by their momentum on the interior surfaces of the air separating enclosure and to drain downward through said drain hole means and said slot for return directly to the crankcase.

2. The housing defined in claim 1, wherein said transition changes of direction are abrupt, and are all greater that a sixty-degree change.

3. The housing defined in claim 1, wherein said transition changes of direction are all substantially greater than 80°.

4. The housing defined in claim 3, wherein said transition changes of direction are at least 90°.

5. The housing defined in claim 1, wherein said first elongated oil separating enclosure is divided into two parts having an abrupt transition change of direction between them, and having different directions of elongation.

6. The housing defined in claim 5, wherein the transition change of direction between the two parts is substantially equal to 180°.

7. The housing defined in claim 5, wherein said upwardly directed vent passages connect with the oil separating enclosure at a position remote from said central lip portal, and said drain hole means includes one drain hole positioned between said vent passages and said central lip portal.

8. The housing defined in claim 1, wherein said drain hole means includes one drain hole positioned in said second elongated oil separation chamber between said lip portal and said stepped passage.

9. The housing defined in claim 1 including at least three of said upwardly directed vent passages.

10. The housing defined in claim 1, further including a recess positioned at the top of said housing wall opening into and connecting said second oil separation chamber and said overlying cover's groove, providing additional transition direction changes.

11. The combination defined in claim 1 wherein the box-shaped housing is a rocker box adapted for installation surmounting a motorcycle engine cylinder.

* * * * *